US012422186B2

(12) United States Patent
Mitsuhashi et al.

(10) Patent No.: US 12,422,186 B2
(45) Date of Patent: Sep. 23, 2025

(54) COOLING DEVICE

(71) Applicant: KOBE STEEL, LTD., Hyogo (JP)

(72) Inventors: Kenichiro Mitsuhashi, Takasago (JP); Yasuhiro Mitarai, Yokohama (JP); Jong Yoon Cho, Yokohama (JP)

(73) Assignee: KOBE STEEL, LTD., Hyogo (JP)

( * ) Notice: Subject to any disclaimer, the term of this patent is extended or adjusted under 35 U.S.C. 154(b) by 560 days.

(21) Appl. No.: 17/758,993

(22) PCT Filed: May 15, 2020

(86) PCT No.: PCT/JP2020/019372
§ 371 (c)(1),
(2) Date: Jul. 18, 2022

(87) PCT Pub. No.: WO2021/166275
PCT Pub. Date: Aug. 26, 2021

(65) Prior Publication Data

US 2023/0032384 A1 Feb. 2, 2023

(30) Foreign Application Priority Data

Feb. 21, 2020 (JP) ..... 2020-027938

(51) Int. Cl.
*F28D 1/06* (2006.01)
*F25J 1/00* (2006.01)
(Continued)

(52) U.S. Cl.
CPC ..... *F25J 1/0262* (2013.01); *F25J 1/0022* (2013.01); *F25J 1/0052* (2013.01); *F25J 5/005* (2013.01);
(Continued)

(58) Field of Classification Search
CPC ..... F25J 1/0052; F25J 1/0262; F25J 1/0272; F25J 1/0087; F25J 5/002; F25J 5/005;
(Continued)

(56) References Cited

U.S. PATENT DOCUMENTS 5,324,452 A * 6/1994 Allam ..... C01B 3/38 252/373
5,385,203 A 1/1995 Mitsuhashi et al.
(Continued)

FOREIGN PATENT DOCUMENTS

EP 0676604 A1 10/1995
EP 1153653 A1 11/2001
(Continued)

OTHER PUBLICATIONS

The extended European search report issued by the European Patent Office on Feb. 22, 2024, which corresponds to European Patent Application No. 20920063.3-1002 and is related to U.S. Appl. No. 17/758,993.

*Primary Examiner* — Frantz F Jules
*Assistant Examiner* — Webeshet Mengesha
(74) *Attorney, Agent, or Firm* — Studebaker Brackett PLLC

(57) ABSTRACT

Provided is a cooling device with which it is possible to cool a fluid to be cooled, even before maintenance work, if a fault such as a blockage or a breakage occurs in a part of a channel. The cooling device (1) is provided with four heat exchangers (1A-1D) and a plurality of heat exchanger connection parts (111-120), each of the heat exchanger connection parts allowing natural gas to flow therethrough. Each of the heat exchangers has: a drum (101, 102, 103, fourth drum 104), a refrigerant reservoir (T), a plurality of heat exchanger core parts (121, 122, 123, 124) immersed in liquid propane in the refrigerant reservoir (T), and a demister (106). A plurality of cooling channels allowing natural gas
(Continued)

to flow therethrough are installed, independent of each other, from the first heat exchanger (1A) to the fourth heat exchanger (1D).

10 Claims, 11 Drawing Sheets

(51) Int. Cl.
*F25J 1/02* (2006.01)
*F25J 5/00* (2006.01)

(52) U.S. Cl.
CPC ..... *F28D 1/06* (2013.01); *F25J 2250/02* (2013.01); *F25J 2290/40* (2013.01)

(58) Field of Classification Search
CPC ..... F25J 1/0085; F25J 1/0082; F28D 1/06; F28D 1/03
See application file for complete search history.

(56) References Cited

U.S. PATENT DOCUMENTS

| | | | | |
|---|---|---|---|---|
| 5,651,270 | A * | 7/1997 | Low | F25J 5/005 62/613 |
| 5,667,005 | A * | 9/1997 | Kakutani | F25J 1/0022 165/DIG. 183 |
| 6,089,313 | A | 7/2000 | Levy et al. | |
| 6,349,566 | B1 * | 2/2002 | Howard | F25J 3/0233 62/903 |
| 2002/0018740 | A1 | 2/2002 | Filippi et al. | |
| 2015/0253071 | A1 * | 9/2015 | Qualls | F25J 3/0209 228/183 |

FOREIGN PATENT DOCUMENTS

| | | | |
|---|---|---|---|
| JP | S61-276675 | A | 12/1986 |
| JP | H06-207791 | A | 7/1994 |
| JP | H07-280465 | A | 10/1995 |

* cited by examiner

COOLING DEVICE

TECHNICAL FIELD

The present invention relates to a cooling device that cools a fluid-to-be-cooled such as a natural gas.

BACKGROUND ART

Conventionally, there is a known cooling device that precools a natural gas (NG) to be supplied to a liquefying device in a process of producing a liquefied natural gas (LNG) by deep-cooling the natural gas by a refrigerant. Patent Document 1 discloses a heat exchange device (cooling device) capable of efficiently separating a refrigerant liquid mist generated by a boil of a refrigerant liquid upon heat exchange with a natural gas in a heat exchanger. In the above technique, the heat exchanger includes a sealed container partitioned into tow partitioned chambers by a vertical partition plate, a refrigerant fluid introducing tube provided in a first partitioned chamber among the two partitioned chambers, a fluid-to-be-cooled distributing tube disposed to pass through the first partitioned chamber, the fluid-to-be-cooled distributing tube having a heat exchange portion at a position lower than height of the partition plate, a demister provided in a second partitioned chamber among the two partitioned chambers, a gas extracting tube that guides a separated gas separated by the demister to an exterior, a discharging tube provided in a bottom portion of the second partitioned chamber, the discharging tube that discharges the separated liquid separated by the demister, and a refrigerant liquid discharging tube provided in a bottom portion of the first partitioned chamber, the refrigerant liquid discharging tube that discharges the refrigerant liquid.

The heat exchange device described in Patent Document 1 includes a plurality of heat exchangers, and a single flow passage disposed to pass through the plurality of heat exchangers, in which a fluid-to-be-cooled such as a natural gas supplied to the flow passage is cooled and liquefied in multiple stages by the plurality of heat exchangers. In the above technique, the refrigerant mist can be diffused from the first partitioned chamber to the second partitioned chamber. Thus, without suppressing evaporation speed of the refrigerant liquid in the first partitioned chamber, it is possible to efficiently separate the refrigerant liquid mist by the demister arranged in the second partitioned chamber. A refrigerant gas extracted from the heat exchange device is not associated with a mist. Thus, it is possible to omit a suction drum provided before a compressor that compresses the refrigerant gas.

CITATION LIST

Patent Document

Patent Document 1: JP7-280465 A

In the heat exchange device described in Patent Document 1, when leakage is generated due to breakage in a portion of a single heat exchanger among part of the flow passage passing through the plurality of heat exchangers in order, the floud-to-be-cooled of the other heat exchangers connected in parallel is also leaked out from the breakage portion. Therefore, there is a need for immediately stopping the entire device and performing maintenance, and there is a problem that cooling of the fluid-to-be-cooled becomes difficult before a planned maintenance time.

SUMMARY OF THE INVENTION

An object of the present invention is to provide a cooling device capable of cooling a fluid-to-be-cooled until a planned maintenance time without stopping the entire device in a case where a failure such as leakage due to breakage is generated in part of a cooling flow passage.

The present invention provides a cooling device capable of receiving, cooling, and discharging a fluid-to-be-cooled, and the cooling device includes a plurality of heat exchangers arranged at different positions from each other in the up and down direction, each of the heat exchangers having a refrigerant container that stores a liquid refrigerant for cooling the fluid-to-be-cooled, and a plurality of heat exchanger core portions immersed in the liquid refrigerant in the refrigerant container, the heat exchanger core portions that respectively permit the fluid-to-be-cooled to flow for performing heat exchange with the liquid refrigerant, and a plurality of heat exchanger connection portions respectively forming a plurality of cooling flow passages for the fluid-to-be-cooled to pass through the plurality of heat exchangers in order by connecting the heat exchanger core portions to each other between the heat exchangers adjacent to each other among the plurality of heat exchangers. Each of the plurality of heat exchanger connection portions includes a receiving port connected to the uppermost heat exchanger serving as the heat exchanger positioned on the uppermost among the plurality of heat exchangers, the receiving port that receives the fluid-to-be-cooled into the cooling flow passage, and a discharging port connected to the lowermost heat exchanger serving as the heat exchanger positioned on the lowermost among the plurality of heat exchangers, the discharging port that discharges the cooled fluid-to-be-cooled from the cooling flow passage. The plurality of cooling flow passages are disposed independently from each other at least from the uppermost heat exchanger to the lowermost heat exchanger.

DESCRIPTION OF EMBODIMENTS

First Embodiment

Figure 1:
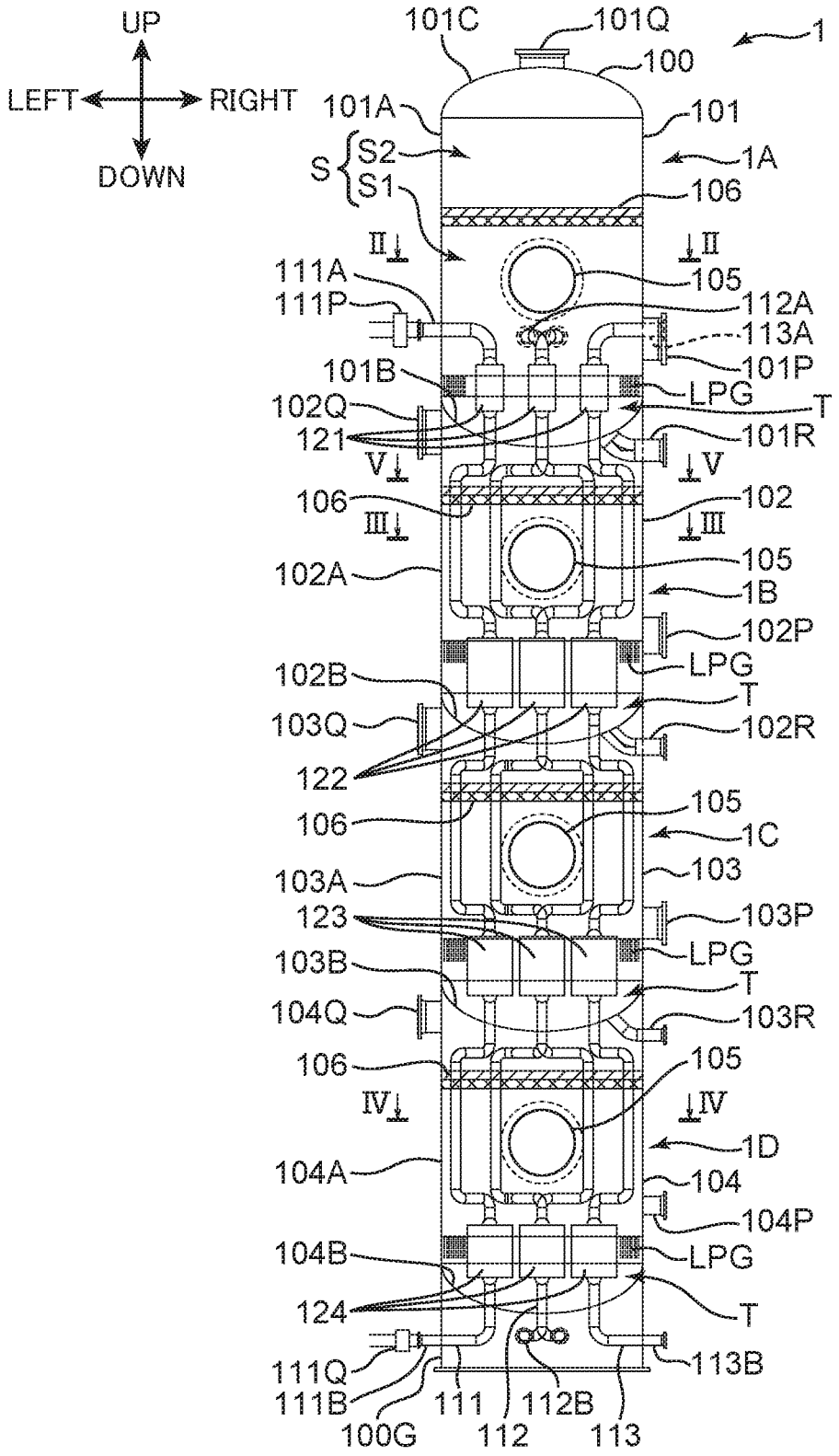
FIG. 1 is a front sectional view of a cooling device according to a first embodiment of the present invention.
Figure 2:
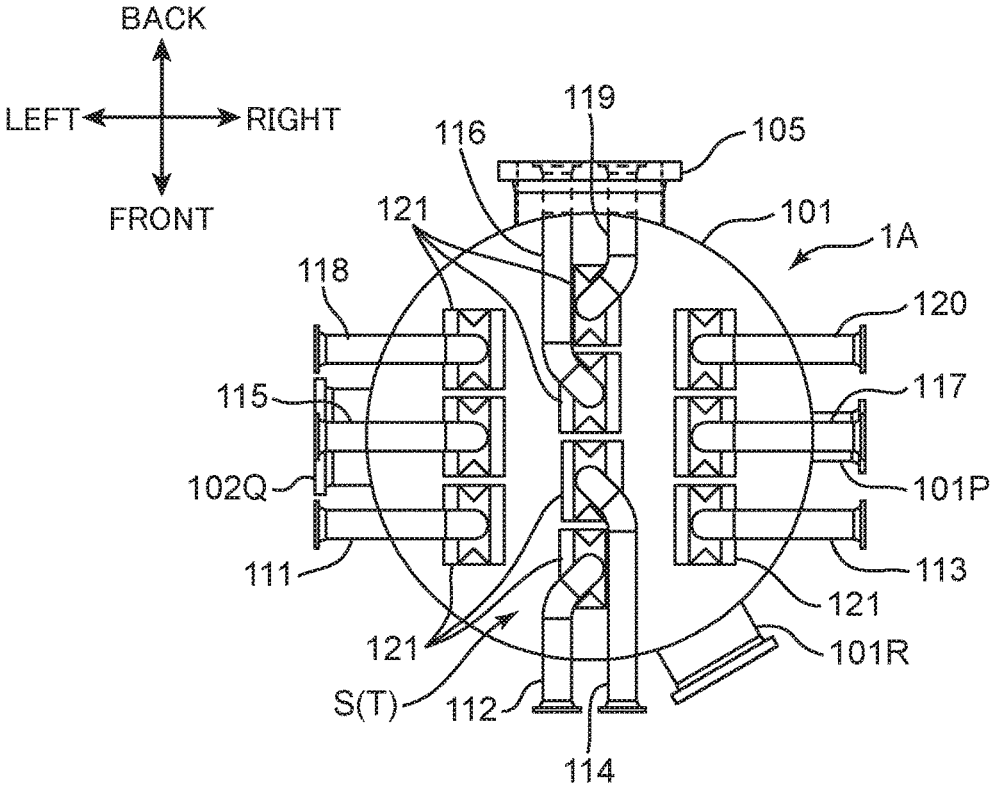
FIG. 2 is a horizontal sectional view of a first heat exchanger of the cooling device according to the first embodiment of the present invention.
Figure 3:
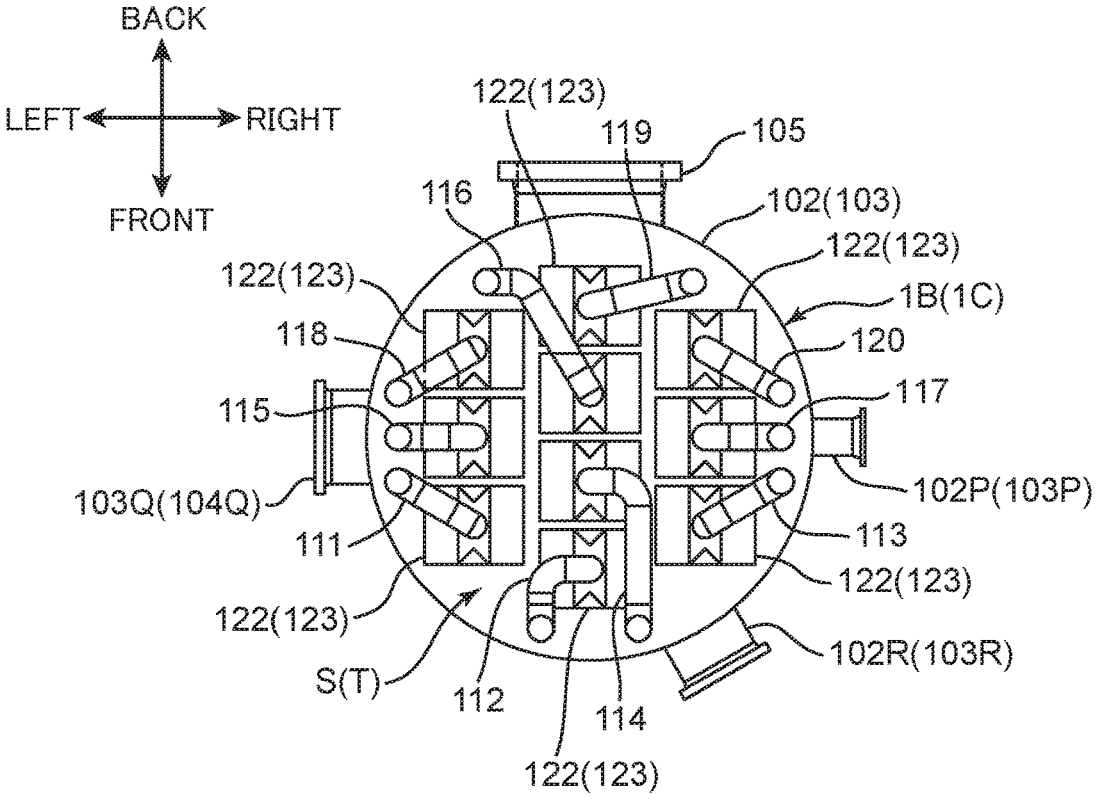
FIG. 3 is a horizontal sectional view of a second heat exchanger or a third heat exchanger of the cooling device according to the first embodiment of the present invention.
Figure 4:
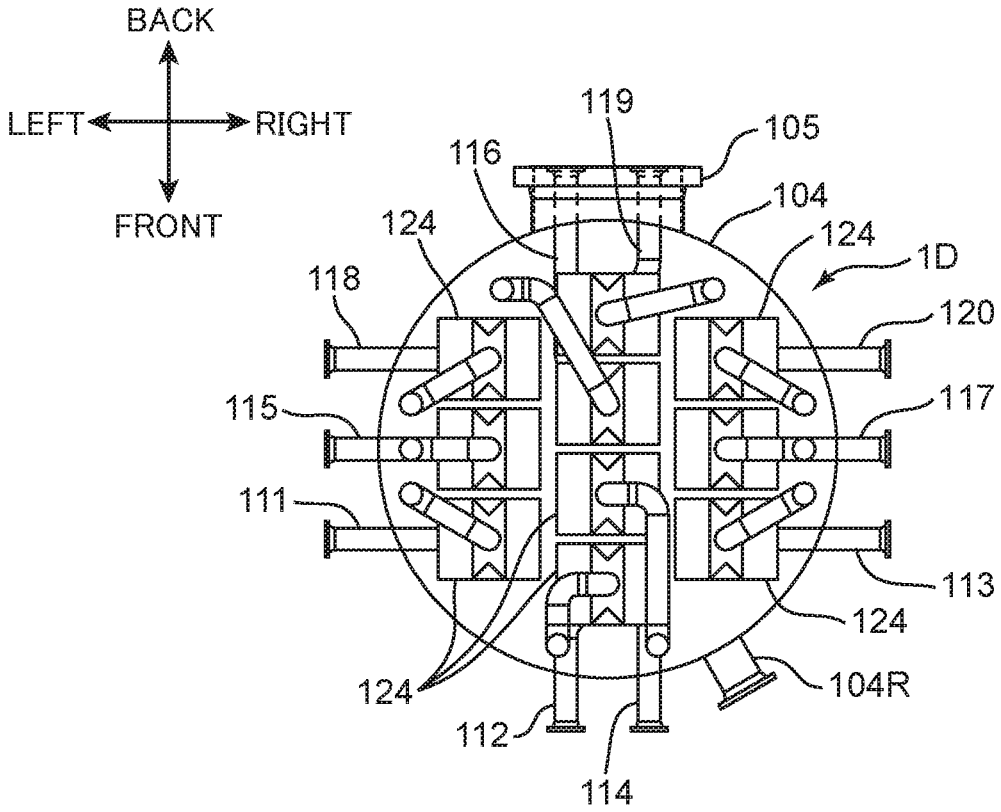
FIG. 4 is a horizontal sectional view of a fourth heat exchanger of the cooling device according to the first embodiment of the present invention.
Figure 5:
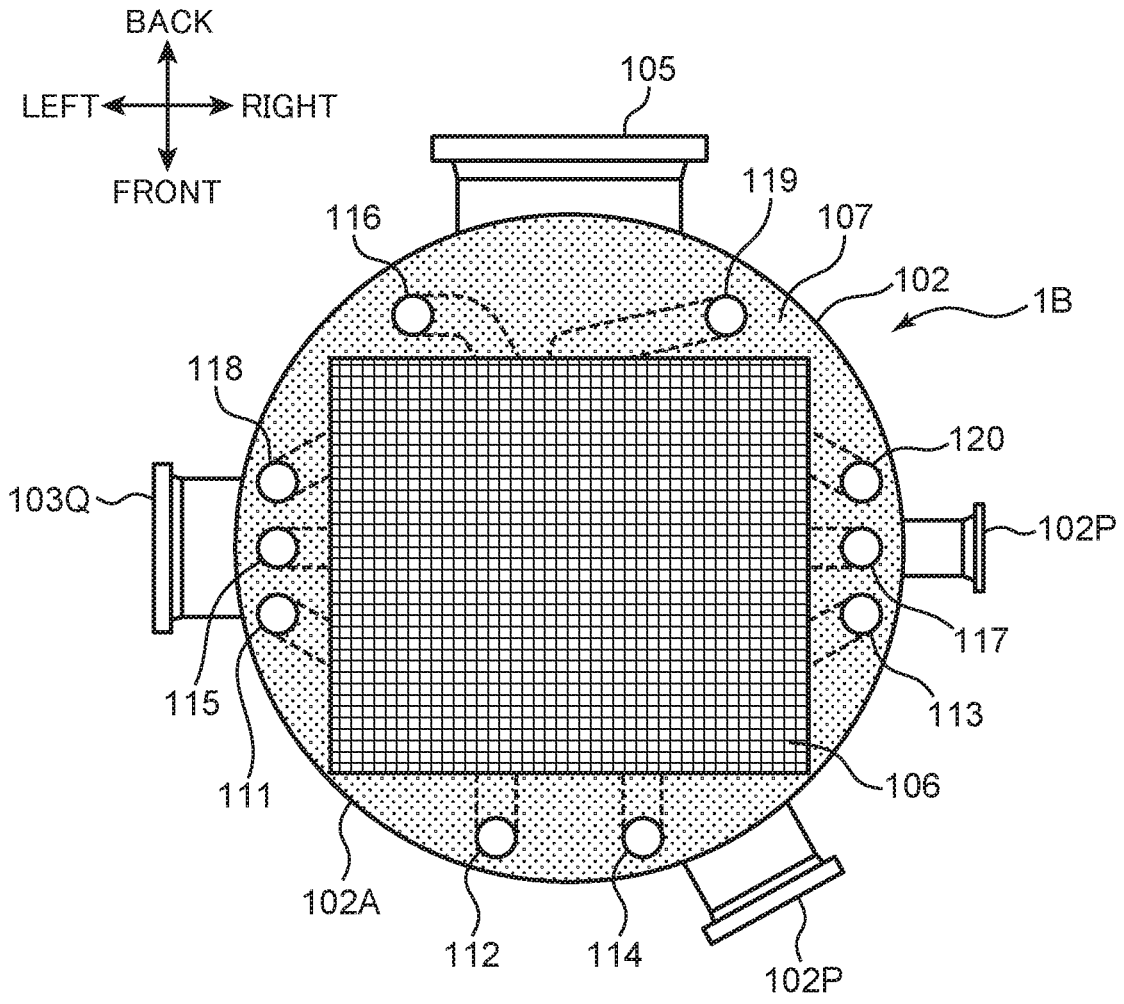
FIG. 5 is a horizontal sectional view around a mist separation portion of the cooling device according to the first embodiment of the present invention.
Figure 6:
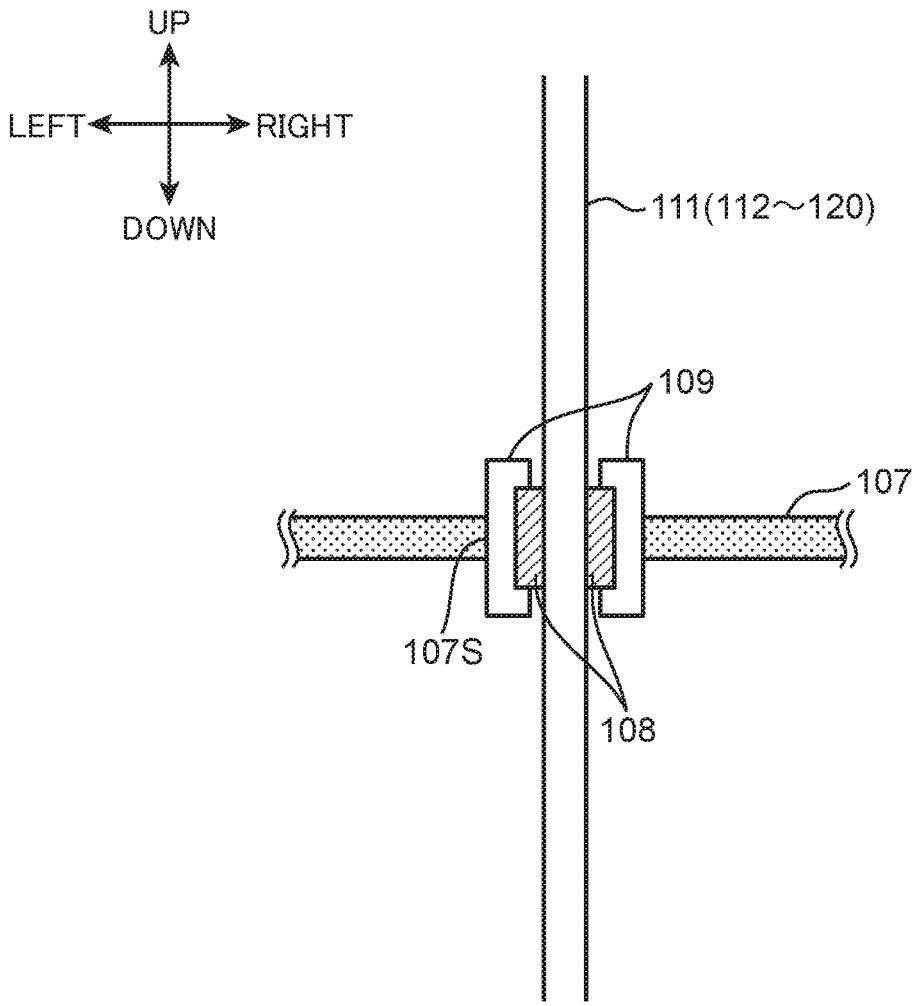
FIG. 6 is a front sectional view of a separation support portion of the cooling device according to the first embodiment of the present invention.

Hereinafter, cooling devices according to embodiments of the present invention will be described based on the drawings. FIG. 1 is a front sectional view of a gas cooling device 1 (cooling device) according to a first embodiment of the present invention. FIG. 2 is a horizontal sectional view of a first heat exchanger 1A of the gas cooling device 1 according to the present embodiment. FIG. 3 is a horizontal sectional view of a second heat exchanger 1B or a third heat exchanger 1C of the gas cooling device 1 according to the present embodiment. FIG. 4 is a horizontal sectional view of a fourth heat exchanger 1D of the gas cooling device 1 according to the present embodiment. FIGS. 2, 3, and 4 correspond to sectional views of positions II-II, III-III, and IV-IV of FIG. 1. Further, FIG. 5 is a horizontal sectional view around a demister 106 (mist separation portion) of the gas cooling device 1 according to the present embodiment. FIG. 5 corresponds to a sectional view of a position V-V of FIG. 1. FIG. 6 is a front sectional view of a demister support 107 of the gas cooling device 1 according to the present embodiment. The directions shown in the figures are not to limit structures and use modes of a cooling device according to the present invention but to describe the gas cooling device 1 according to the present embodiment. The same also applies to the following embodiments.

The gas cooling device 1 according to the present embodiment is a cooling device that cools a fluid-to-be-cooled such as a natural gas and a mixture refrigerant with using propane (refrigerant), the cooling device being arranged in an LNG plant and also called as a propane chiller. The gas cooling device 1 receives, cools, and discharges the fluid-to-be-cooled. In particular, in the present embodiment, the gas cooling device 1 receives a gaseous natural gas (NG) and cools with evaporation latent heat of propane. With reference to FIG. 1, the gas cooling device 1 has the first heat exchanger 1A, the second heat exchanger 1B, the third heat exchanger 1C, and the fourth heat exchanger 1D (all are heat exchangers and sometimes collectively expressed as the first heat exchanger 1A to the fourth heat exchanger 1D). These first heat exchanger 1A to the fourth heat exchanger 1D form a plurality of heat exchangers in the present invention.

The first heat exchanger 1A, the second heat exchanger 1B, the third heat exchanger 1C, and the fourth heat exchanger 1D are arranged at different positions from each other in the up and down direction, and in more detail, these heat exchangers are connected to each other along the up and down direction (piled up). The gas cooling device 1 has a first connection tube 111, a second connection tube 112, a third connection tube 113, a fourth connection tube 114, a fifth connection tube 115, a sixth connection tube 116, a seventh connection tube 117, an eighth connection tube 118, a ninth connection tube 119, and a tenth connection tube 120 (hereinafter, sometimes collectively expressed as the first connection tube 111 to the tenth connection tube 120). These connection tubes form a plurality of heat exchanger connection portions (a specific number of heat exchanger connection portions) in the present invention. In the present embodiment, the specific number is ten. The first connection tube 111 to the tenth connection tube 120 respectively form a plurality of cooling flow passages for a natural gas (fluid-to-be-cooled) to pass through the plurality of heat exchangers in order by connecting heat exchanger core portions to be described later to each other between the heat exchangers adjacent to each other among the plurality of heat exchangers.

The first heat exchanger 1A, the second heat exchanger 1B, the third heat exchanger 1C, and the fourth heat exchanger 1D respectively have a first drum 101, a second drum 102, a third drum 103, and a fourth drum 104 (all are refrigerant containers) (hereinafter, sometimes collectively expressed as the first drum 101 to the fourth drum 104 or the plurality of drums). Each of the first drum 101 to the fourth drum 104 has a manhole 105 for maintenance and the demister 106 (mist separation portion). In an interior of each drum, an internal space S in which the first connection tube 111 to the tenth connection tube 120 are partly accommodated is formed. The internal space S is partitioned into a lower space S1 and an upper space S2 by the demister 106 described above. Hereinafter, a detailed structure of the first heat exchanger 1A will be described.

The first drum 101 of the first heat exchanger 1A is a cylindrical member having a center axis which extends in the up and down direction, and the internal space S in which part of the first connection tube 111 to the tenth connection tube 120 (cooling flow passages) are accommodated is formed in the interior of the first drum 101. The first drum 101 has a first trunk portion 101A (side wall) defining a side surface of the internal space S, a first bottom portion 101B (bottom wall) connected to a lower end portion of the first trunk portion 101A, the first bottom portion defining a lower surface portion of the internal space S, and a first lid portion 101C (upper wall portion) connected to an upper end portion of the first trunk portion 101A, the first lid portion defining an upper surface portion of the internal space S. The first trunk portion 101A is formed in a cylindrical shape, and the first bottom portion 101B and the first lid portion 101C are respectively arranged to close the lower end portion and the upper end portion of the first trunk portion 101A. The first bottom portion 101B is formed in a downward-projected semispherical shape (curved surface shape) so that a center portion thereof is positioned on the lower side of the other portion (peripheral edge portion). The first lid portion 101C is formed in an upward-projected semispherical shape (curved surface shape) so that a center portion thereof is positioned on the upper side of the other portion (peripheral edge portion).

The first heat exchanger 1A has a propane liquid supply portion 101P (refrigerant supplying port, the same applies hereinafter), a propane gas discharge portion 101Q (refrigerant gas discharging port, the same applies hereinafter), and a propane liquid discharge portion 101R. The propane liquid supply portion 101P is arranged in the first trunk portion 101A of the first drum 101 to communicate with the lower space S1 of the internal space S, and permits liquid propane (liquid refrigerant) for cooling the natural gas to be supplied to the internal space S. The lower end portion of the first trunk portion 101A and the first bottom portion 101B form a refrigerant storage portion T capable of storing the liquid propane supplied to the internal space S through the propane liquid supply portion 101P.

The propane gas discharge portion 101Q is arranged in a top portion of the first lid portion 101C of the first drum 101 to communicate with the upper space S2 of the internal space S, and permits a propane gas (refrigerant gas) separated by the demister 106 to be discharged from the first drum 101.

The propane liquid discharge portion 101R is arranged in the first bottom portion 101B and permits part of the liquid propane to be discharged from the refrigerant storage portion T.

The first heat exchanger 1A further has ten first heat exchanger core portions 121 (a plurality of heat exchanger core portions, a specific number of heat exchanger core portions, the same applies hereinafter) (FIG. 2). The ten first heat exchanger core portions 121 are arranged in the first drum 101 to be immersed in the liquid propane of the refrigerant storage portion T, and permit the natural gas to flow for performing heat exchange with the liquid propane.

Each one of the ten first heat exchanger core portions 121 is disposed in (connected to) each of the first connection tube 111 to the tenth connection tube 120 in the internal space S of the first drum 101. In the present embodiment, the ten first heat exchanger core portions 121 are known plate-fin heat exchangers having a structure in which a plurality of corrugated plates and a plurality of flat plates are alternately laminated and aluminum-brazed. As a result, in an interior of each of the first heat exchanger core portions 121, a high-temperature stage and a low-temperature stage (not shown) that respectively permit a fluid to flow are alternately formed. The ten first heat exchanger core portions 121 may have a diffusion bonding structure. The same applies to the other embodiments to be described below.

The demister 106 is arranged at a position higher than the ten first heat exchanger core portions 121 in the internal space S of the first drum 101, and is capable of separating the propane gas (refrigerant gas) and mist-shaped propane (refrigerant mist) associated with the propane gas from each other, the propane gas and the mist-shaped propane being respectively generated from the liquid propane by heat exchange with the natural gas. In the present embodiment, the demister 106 is arranged on the vertically upper side of the ten first heat exchanger core portions 121 in the internal space S of the first drum 101 so that the mist-shaped propane and the propane gas generated from the liquid propane are capable of reaching the demister 106 when brought up from the ten first heat exchanger core portions 121. The first bottom portion 101B is arranged on the vertically lower side of the demister 106 so that the mist-shaped liquid propane captured by the demister 106 is capable of dropping down to the liquid propane stored in the refrigerant storage portion T. The liquid propane may be returned to the refrigerant storage portion T along an inner peripheral surface of the first trunk portion 101A.

Next, the second heat exchanger 1B, the third heat exchanger 1C, and the fourth heat exchanger 1D will be described. However, different points from the first heat exchanger 1A will be mainly described, and common points to the first heat exchanger 1A will not be described.

As well as the first drum 101, the second drum 102 of the second heat exchanger 1B is a cylindrical member having a center axis which extends in the up and down direction, and an internal space S in which part of the first connection tube 111 to the tenth connection tube 120 are accommodated is formed in an interior of the second drum 102. The second drum 102 has a second trunk portion 102A (side wall) defining a side surface of the internal space S, and a second bottom portion 102B (bottom wall) connected to a lower end portion of the second trunk portion 102A, the second bottom portion defining a lower surface portion of the internal space S. An upper wall portion (ceiling portion) of the second drum 102 is formed by the first bottom portion 101B of the first drum 101, and the first bottom portion 101B defines an upper surface portion of the internal space S of the second drum 102 by being connected to an upper end portion of the second trunk portion 102A.

The second heat exchanger 1B has a propane liquid supply portion 102P (refrigerant supplying port), a propane gas discharge portion 102Q, and a propane liquid discharge portion 102R. These have the same functions as the propane liquid supply portion 101P, the propane gas discharge portion 101Q, and the propane liquid discharge portion 101R of the first heat exchanger 1A. The propane gas discharge portion 102Q is arranged to oppose the projected portion of the first bottom portion 101B of the first drum 101 (upper wall portion of the second drum 102) in the horizontal direction. The second heat exchanger 1B has ten second heat exchanger core portions 122 each one of which is arranged in each of the first connection tube 111 to the tenth connection tube 120.

The propane liquid discharge portion 102R is arranged in the second bottom portion 102B and permits part of the liquid propane to be discharged from the refrigerant storage portion T.

The third heat exchanger 1C has the same configuration as the second heat exchanger 1B. The third drum 103 of the third heat exchanger 1C has a third trunk portion 103A (side wall), and a third bottom portion 103B (bottom wall). An upper wall portion (ceiling portion) of the third drum 103 is formed by the second bottom portion 102B of the second drum 102. The third heat exchanger 1C has a propane liquid supply portion 103P (refrigerant supplying port), a propane gas discharge portion 103Q, and a propane liquid discharge portion 103R. The third heat exchanger 1C further has ten third heat exchanger core portions 123 each one of which is arranged in each of the first connection tube 111 to the tenth connection tube 120.

The fourth heat exchanger 1D has the substantially same configuration as the second heat exchanger 1B and the third heat exchanger 1C. The fourth drum 104 of the fourth heat exchanger 1D has a fourth trunk portion 104A (side wall), and a fourth bottom portion 104B (bottom wall). An upper wall portion (ceiling portion) of the fourth drum 104 is formed by the third bottom portion 103B of the third drum 103. The fourth heat exchanger 1D has a propane liquid supply portion 104P (refrigerant supplying port), a propane gas discharge portion 104Q, and a propane liquid discharge portion 104R (FIG. 4). The fourth heat exchanger 1D further has ten fourth heat exchanger core portions 124 each one of which is arranged in each of the first connection tube 111 to the tenth connection tube 120.

The first drum 101 of the first heat exchanger 1A, the second drum 102 of the second heat exchanger 1B, the third drum 103 of the third heat exchanger 1C, and the fourth drum 104 of the fourth heat exchanger 1D are integrated as a casing 100 by being bonded to each other in the up and down direction. The gas cooling device 1 has a base 100G arranged in a lower end portion of the casing 100, the base being installable on the ground.

In the present embodiment, the ten heat exchanger core portions are arranged in each of the four heat exchangers. Each of the first connection tube 111 to the tenth connection tube 120 (a specific number of heat exchanger connection portions) connects a single heat exchanger core portion and a single heat exchanger core portion between the heat exchangers adjacent to each other among the four heat exchangers so that the single heat exchanger core portion is disposed in a single cooling flow passage among the ten cooling flow passages in the four heat exchangers.

As shown in FIG. 5, the demister 106 of the second heat exchanger 1B has a rectangular shape in a top view. The demister 106 separates the propane gas and the propane mist by permitting the propane gas to pass through from the lower side while inhibiting the propane mist from passing through. The second heat exchanger 1B further has the demister support 107 (separation support portion) arranged in the internal space S. An outer edge portion of the demister 106 is supported by the demister support 107. The demister support 107 has an outer peripheral edge bonded to an inner peripheral surface of the second trunk portion 102A of the second drum 102.

In the demister support 107, ten hole portions 107S (FIG. 6) are respectively opened corresponding to the first connection tube 111 to the tenth connection tube 120 (FIG. 5). The demister support 107 has cylindrical meshes 108 each of which is arranged in each of the hole portions 107S, and cylindrical mesh covers 109 each of which is fixed to each of the hole portions 107S and supports each of the meshes 108. By respectively inserting the pipes of the first connection tubes 111 to the tenth connection tube 120 into the hole portions 107S, the demister support 107 inhibits the propane gas and the propane mist from passing through the demister support 107 while permitting the first connection tube 111 to the tenth connection tube 120 to pass through the demister 106 (demister support 107) along the up and down direction. As a result, the first connection tube 111 to the tenth connection tube 120 are disposed to extend in the up and down direction in the internal space S along an inner surface of the second trunk portion 102A until reaching the second bottom portion 102B from the upper wall portion (first bottom portion 101B) of the second heat exchanger 1B via the demister support 107 (FIG. 1). The meshes 108 are elastically-deformable corresponding to variation of positions of the pipes, and by sealing peripheries of the hole portions 107S, inhibit the propane mist from going into the upper space S2 on the upper side of the demister 106. Structures of FIGS. 5 and 6 are the same in the first heat exchanger 1A, the third heat exchanger 1C, and the fourth heat exchanger 1D.

As shown in FIG. 1, the first connection tube 111 has an NG supply portion 111A (receiving port, the same applies hereinafter), and an NG discharge portion 111B (discharging port, the same applies hereinafter). The second connection tube 112 has an NG supply portion 112A and an NG discharge portion 112B. Further, the third connection tube 113 has an NG supply portion 113A and an NG discharge portion 113B. The NG supply portions 111A, 112A, 113A are connected to the first heat exchanger 1A (uppermost heat exchanger) serving as a heat exchanger positioned on the uppermost among the plurality of heat exchangers, and receive the natural gas (NG) into the flow passages. The NG discharge portions 111B, 112B, 113B are connected to the fourth heat exchanger 1D (lowermost heat exchanger) serving as a heat exchanger positioned on the lowermost among the plurality of heat exchangers, and discharge the natural gas (cooled fluid-to-be-cooled) from the flow passages. The fourth connection tube 114, the fifth connection tube 115, the sixth connection tube 116, the seventh connection tube 117, the eighth connection tube 118, the ninth connection tube 119, and the tenth connection tube 120 also have the same structures as the structures described above, and description thereof will be omitted. The first connection tube 111 to the tenth connection tube 120 are respectively disposed so that the natural gas passes through the plurality of heat exchangers in order from the first heat exchanger 1A to the fourth heat exchanger 1D. At least from the first heat exchanger 1A to the fourth heat exchanger 1D, the cooling flow passages formed by the first connection tube 111 to the tenth connection tube 120 are disposed independently from each other.

Further, the first connection tube 111 has an inlet side shutoff valve 111P and an outlet side shutoff valve 111Q. The inlet side shutoff valve 111P is a shutoff valve (mechanism) capable of closing to inhibit the natural gas from flowing into the first connection tube 111 from the NG supply portion 111A. The outlet side shutoff valve 111Q is a shutoff valve (mechanism) capable of closing to inhibit the natural gas from being discharged and flowing back into the first connection tube 111 from the NG discharge portion. The inlet side shutoff valve 111P and the outlet side shutoff valve 111Q are closed by remote control or manual control in a case where a damage such as leakage is generated in the heat exchangers. Both the inlet side shutoff valve 111P and the outlet side shutoff valve 111Q are arranged. Although FIG. 1 shows the inlet side shutoff valve 111P and the outlet side shutoff valve 111Q in the first connection tube 111, the same shutoff valves are respectively arranged even in the other second connection tube 112 to the tenth connection tube 120. In place of the shutoff valves described above, a flow of the natural gas may be inhibited by baffle plates (mechanisms), etc.

As shown in FIG. 1, by respectively passing through the bottom portion (bottom wall) of the drum of a single heat exchanger among the plurality of heat exchangers and the upper wall portion of another heat exchanger arranged on the lower side of the single heat exchanger, the flow passages of the first connection tube 111 to the tenth connection tube 120 are respectively disposed to go from the internal space S of the single heat exchanger into the internal space S of the another heat exchanger. The first connection tube 111 to the tenth connection tube 120 are disposed to extend in the up and down direction in the internal space S along inner surfaces of the trunk portions until reaching the bottom portions from the upper wall portions of the drums via the demister supports 107 in the second heat exchanger 1B, the third heat exchanger 1C, and the fourth heat exchanger 1D. Therefore, as shown in FIGS. 3 and 4, the flow passages are housed in the drums of the heat exchangers, and not disposed outside the drums.

Next, a flow of liquefication of the natural gas in the gas cooling device 1 according to the present embodiment will be described. As shown in FIG. 1, in each of the heat exchangers, the plate-fin type heat exchanger core portions are immersed in the liquid propane stored in the refrigerant storage portion T. The demister 106 is arranged immediately above the heat exchanger core portions. The natural gas (or a mixture gas) flowing through the flow passages is cooled and liquefied by evaporation latent heat of the liquid propane in the each of heat exchangers. Specifically, the heat exchanger core portions in each of the heat exchangers are alternately laminated so that high-temperature stages and low-temperature stages are in contact with each other. The liquid propane serving as a low-temperature fluid is stored in the refrigerant storage portion T, and a liquid surface thereof is positioned on the slightly lower side of upper surface portions of the heat exchanger core portions. The low-temperature stages of the heat exchanger core portions are exposed to the refrigerant storage portion T and the low-temperature stages of the heat exchanger core portions are filled with the liquid propane. Meanwhile, the natural gas serving as a high-temperature fluid flows to the high-temperature stages of the heat exchanger core portions from headers (not shown) arranged in the heat exchanger core portions. The natural gas warms up the high-temperature stages of the heat exchanger core portions, and heat of the high-temperature stages warms up the adjacent low-temperature stages. Therefore, part of the liquid propane filling the low-temperature stages is evaporated by the heat and brought into a gas-liquid mixing phase (of the propane gas and the liquid propane). Since density of the gas-liquid mixing phase is lower than liquid density, the gas-liquid mixing phase is brought up in the low-temperature stages of the heat exchanger core portions. As a result, cold liquid propane flows into lower portions of the low-temperature stages from the refrigerant storage portion T. The natural gas from which heat is removed is discharged from the heat exchanger core portions in a cooled state, and supplied to the next heat exchanger. By repeating the phenomenon described above in the first heat exchanger 1A to the fourth heat exchanger 1D, the natural gas is cooled to the vicinity of the temperature of propane on the lowermost stages.

In the plurality of heat exchangers 1A to 1D, part of the liquid propane supplied to the upper heat exchanger is drawn out, decompressed, and then supplied to the heat exchanger immediately below. Specifically, in the first heat exchanger 1A of FIG. 1, part of the liquid propane is discharged from the propane liquid discharge portion 101R, decompressed by a decompression valve (not shown), and then supplied to the internal space S from the propane liquid supply portion 102P of the second heat exchanger 1B. Similarly, part of the liquid propane not-yet-evaporated in the second heat exchanger 1B is discharged from the propane liquid discharge portion 102R, decompressed by a decompression valve (not shown), and then supplied to the internal space S from the propane liquid supply portion 103P of the third heat exchanger 1C. Part of the liquid propane not-yet-evaporated in the third heat exchanger 1C is discharged from the propane liquid discharge portion 103R, decompressed by a decompression valve (not shown), and then supplied to the internal space S from the propane liquid supply portion 104P of the fourth heat exchanger 1D. Part of the liquid propane supplied exclusively to the heat exchanger immediately above is decompressed by the decompression valve (not shown) and then supplied to the second heat exchanger 1B, the third heat exchanger 1C, and the fourth heat exchanger 1D. Therefore, the cooled liquid propane is supplied to the lower heat exchanger. Consequently, the pressure of the liquid propane is lowered stepwise, and the natural gas (or the mixture gas) is gradually cooled from the high-pressure stages to the low-pressure stages.

Further, the propane gasified in the heat exchangers is respectively discharged from the propane gas discharge portions 101Q, 102Q, 103Q, and 104Q, and flows into a four-stage compressor (not shown) adjacently connected to the gas cooling device 1. Specifically, the propane gas discharged from the propane gas discharge portion 101Q of the first heat exchanger 1A is supplied to a first stage of the compressor and compressed. Similarly, the propane gas discharged from the propane gas discharge portion 102Q of the second heat exchanger 1B is supplied to a second stage of the compressor and compressed, and then further supplied to the first stage of the compressor and compressed. Similarly, the propane gas discharged from the propane gas discharge portion 103Q of the third heat exchanger 1C is supplied to a third stage, the second stage, and the first stage of the compressor in order while being compressed. The propane gas discharged from the propane gas discharge portion 104Q of the fourth heat exchanger 1D is supplied to a fourth stage, the third stage, the second stage, and the first stage of the compressor in order while being compressed. The propane compressed by the compressor is supplied to the propane liquid supply portion 101P as the liquid propane.

Upon respectively disposing the first connection tube 111 to the tenth connection tube 120 in each of the heat exchangers, pipes of the flow passages are disposed to pass through the demister support 107 around the demister 106 as described above. The demister support 107 has a structure of permitting heat transfer. The flow passages are disposed to pass through the first bottom portion 101B, the second bottom portion 102B, the third bottom portion 103B, and the fourth bottom portion 104B among the first drum 101, the second drum 102, the third drum 103, and the fourth drum 104. In a case where the natural gas (or the mixture refrigerant) is depressurized due to abnormal operation, a low-temperature fluid of −100° C. or lower flows back from the downstream. Thus, there is a possibility that the connection tubes 111 to 120 have a low temperature of −100° C. Therefore, for these bottom portions through which the connection tubes pass, low-temperature-resistant stainless steel which has resistance to an environment of −100° C. is desirably used. Meanwhile, with such a structure, connection between the heat exchangers by the first connection tubes 111 to the tenth connection tubes 120 is performed by passing through the bottom wall and the upper wall portion of the upper and lower drums. Since the flow passages do not pass through the second trunk portion 102A, the third trunk portion 103A, and the fourth trunk portion 104A, bound points become minimum, and it is possible to suppress thermal stress generated in the connection tubes to the minimum. In addition, there is no need for using a low-temperature-resistant material for these trunk portions, and it is possible to use carbon steel which is less expensive than the stainless steel described above. In other words, there is no more need for using a low-temperature-resistant material such as stainless steel for these trunk portions.

As described above, in the present embodiment, at least from the first heat exchanger 1A (uppermost heat exchanger) to the fourth heat exchanger 1D (lowermost heat exchanger), the first connection tube 111 to the tenth connection tube 120 are disposed independently from each other. Thus, even in a case where a damage such as leakage is generated in any one of the flow passages, by closing the flow passage with the shutoff valve, it is possible to continuously cool and liquefy the natural gas in the other flow passages.

In the present embodiment, the gas cooling device 1 has the structure in which the plurality of heat exchangers (of the first heat exchanger 1A, the second heat exchanger 1B, the third heat exchanger 1C, and the fourth heat exchanger 1D) are piled up in the up and down direction. Therefore, in comparison to a structure in which a plurality of heat exchangers are arranged adjacently along the horizontal direction, it is possible to reduce an installment area of the gas cooling device 1.

In the present embodiment, in the internal space S of the drum (refrigerant container) of each of the heat exchangers, the demister 106 is arranged on the vertically upper side of the heat exchanger core portions. Thus, the mist-shaped liquid propane captured by the demister 106 can directly drop down to the refrigerant storage portion T. Therefore, it is possible to effectively utilize a space in an upper portion of the heat exchanger required for maintenance of the heat exchanger as the mist separation portion. Thus, it is possible to minimize size of the entire device.

In each of the heat exchangers, a single core (heat exchanger core portion) is disposed in each of the flow passages of the first connection tube 111 to the tenth connection tube 120, and the flow passage does not branch in each of the drums. In other words, the core is not connected to the flow passage in parallel. Therefore, in a case where a two-phase flow of a gas and a liquid is generated at the time of condensing the natural gas on the high temperature side in the core, there is no need for re-dispersing the two-phase flow between the plurality of cores unlike a case where cores are connected in parallel in a heat exchanger. Thus, deviation of a flow rate between the cores is maintained to be minimum, and it is possible to prevent a decrease in a cooling processing capability.

Further, in the present embodiment, each of the first connection tube 111 to the tenth connection tube 120 has at least one of the inlet side shutoff valve 111P and the outlet side shutoff valve 111Q. With such a configuration, in a case where a damage such as leakage is generated in a predetermined flow passage, it is possible to promptly stop the flow of the natural gas in the flow passage, and prevent leakage of the natural gas to an exterior of the flow passage. It is also possible to stably continue cooling processing of the natural gas in the other flow passages.

In the present embodiment, in the drum of each of the heat exchangers, the demister 106 is supported by the demister support 107, and the first connection tube 111 to the tenth connection tube 120 are disposed to extend in the up and down direction in the internal space S along the inner surface of the trunk portion of the drum until reaching the bottom portion from the upper wall portion of the heat exchanger via the demister support 107. Therefore, the demister support 107 can stably support the demister 106, and the flow passages can be respectively disposed along the up and down direction over the two regions (of the lower space S1 and the upper space S2) of the internal space S divided by the demister 106. The flow passages are not required to pass through the trunk portion of the drum, and a need for using a low-temperature-resistant material for the trunk portion is reduced.

In the present embodiment, the drum of each of the heat exchangers has a cylindrical shape having a center axis which extends in the up and down direction. Therefore, it is possible to stably store the liquid propane in the refrigerant storage portion T of the internal space S. Since the drums having a cylindrical shape are disposed along the up and down direction, it is possible to reduce size of the gas cooling device 1 along the horizontal direction. It is also possible to reduce the installment area of the gas cooling device 1.

Further, in the present embodiment, between the heat exchangers adjacent to each other in the up and down direction, the bottom wall of the upper heat exchanger also serves as the upper wall portion of the lower heat exchanger, and it is possible to share the bottom wall and the upper wall portion by a single wall member. Therefore, it is possible to reduce height size of the gas cooling device 1 (thickness between the heat exchangers), and also reduce cost of the gas cooling device 1.

In the present embodiment, the bottom portion (bottom wall) of the drum of each of the heat exchangers is formed by a downward-projected curved surface (half-cylindrical surface). Therefore, it is possible to ensure a space in which the liquid propane is stored and the heat exchanger core portion is immersed in the refrigerant storage portion T defined by the bottom portion of the drum. Between the plurality of heat exchangers, the pressure of the liquid propane stored in the interior is larger in the upper heat exchanger than in the lower heat exchanger. Therefore, by downward-projecting the bottom portion of the drum as described above, a design that high strength is given to the higher-pressure container side is obtained, and in comparison to a case where the bottom portion is a horizontally flat plate, it is possible to enhance strength of the bottom portion without increasing thickness of the bottom portion.

Further, in the present embodiment, in each of the second heat exchanger 1B, the third heat exchanger 1C, and the fourth heat exchanger 1D, the propane gas discharge portion is disposed to oppose the projected portion of the upper wall portion in the horizontal direction. With such a configuration, the propane gas separated by the demister 106 tends to be accumulated in a ring shape in a radially outside portion of the upper wall portion of the heat exchanger. When part of the ring-shaped propane gas is discharged from the propane gas discharge portion, the surrounding propane gas follows the part of the propane gas and flows into the propane gas discharge portion. Therefore, it is possible to stably discharge the separated propane gas from the interior of the drum through the propane gas discharge portion.

Regarding the present embodiment shown in FIG. 1, in other words, the gas cooling device 1 includes the tubular casing 100 extending along the up and down direction, and a plurality of partition portions (of the first bottom portion 101B, the second bottom portion 102B, and the third bottom portion 103B) that divide an interior of the casing 100 into the plurality of refrigerant storage portions T arranged adjacently to each other in the up and down direction. The drums (refrigerant containers) of the plurality of heat exchangers are formed by the casing and the plurality of partition portions. The plurality of heat exchanger core portions of each of the plurality of heat exchangers are arranged to be immersed in the liquid propane in each of the plurality of refrigerant storage portions T in the casing 100, and the first connection tube 111 to the tenth connection tube 120 (plurality of heat exchanger connection portions) are respectively disposed to pass through the plurality of partition portions.

With such a configuration, by partitioning the interior of the casing 100 by the plurality of partition portions, it is possible to form the plurality of refrigerant storage portions T. By respectively arranging the plurality of heat exchanger core portions in each of the refrigerant storage portions T, it is possible to form a multiple-stage type cooling device.

Second Embodiment

Figure 7:
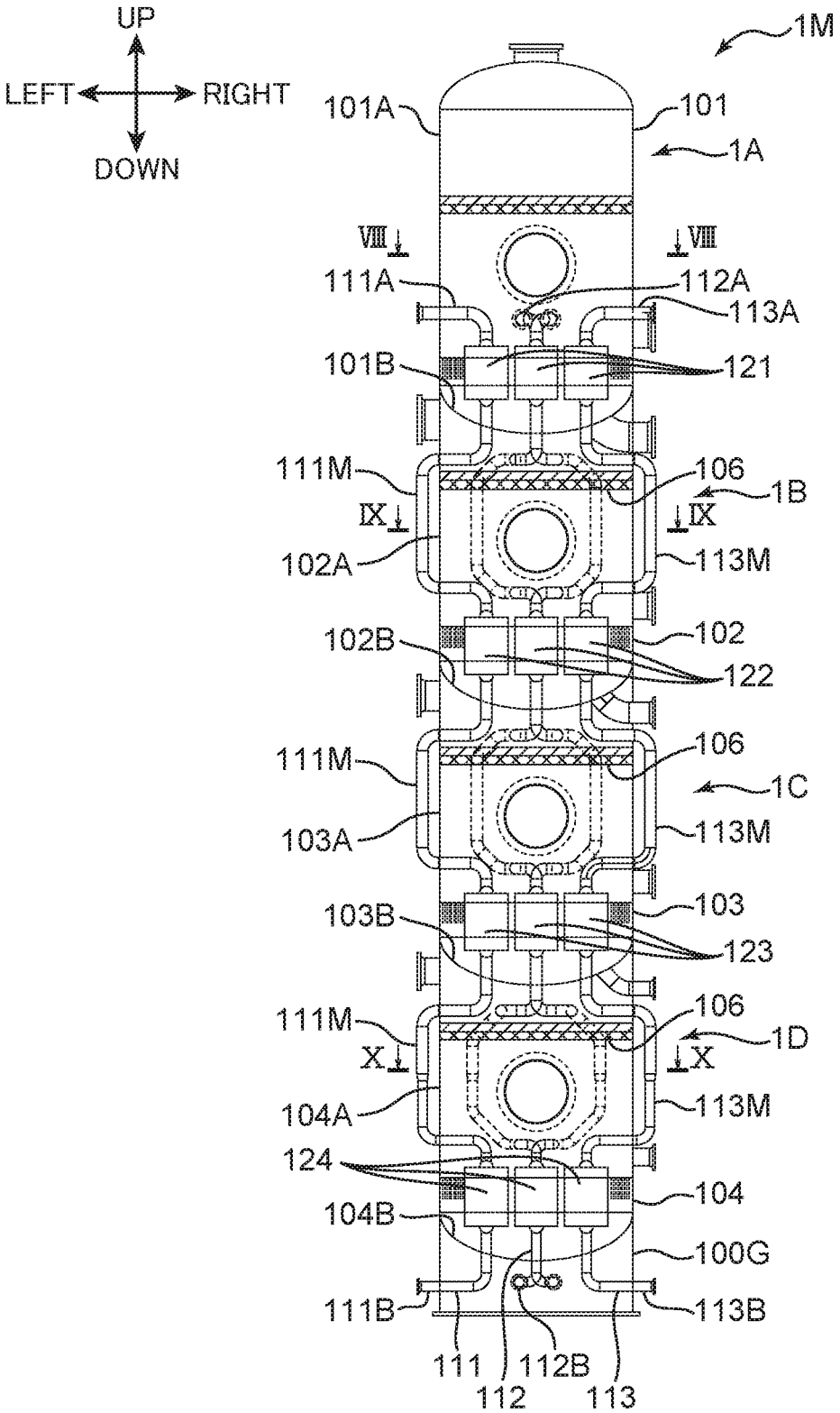
FIG. 7 is a front sectional view of a cooling device according to a second embodiment of the present invention.
Figure 8:
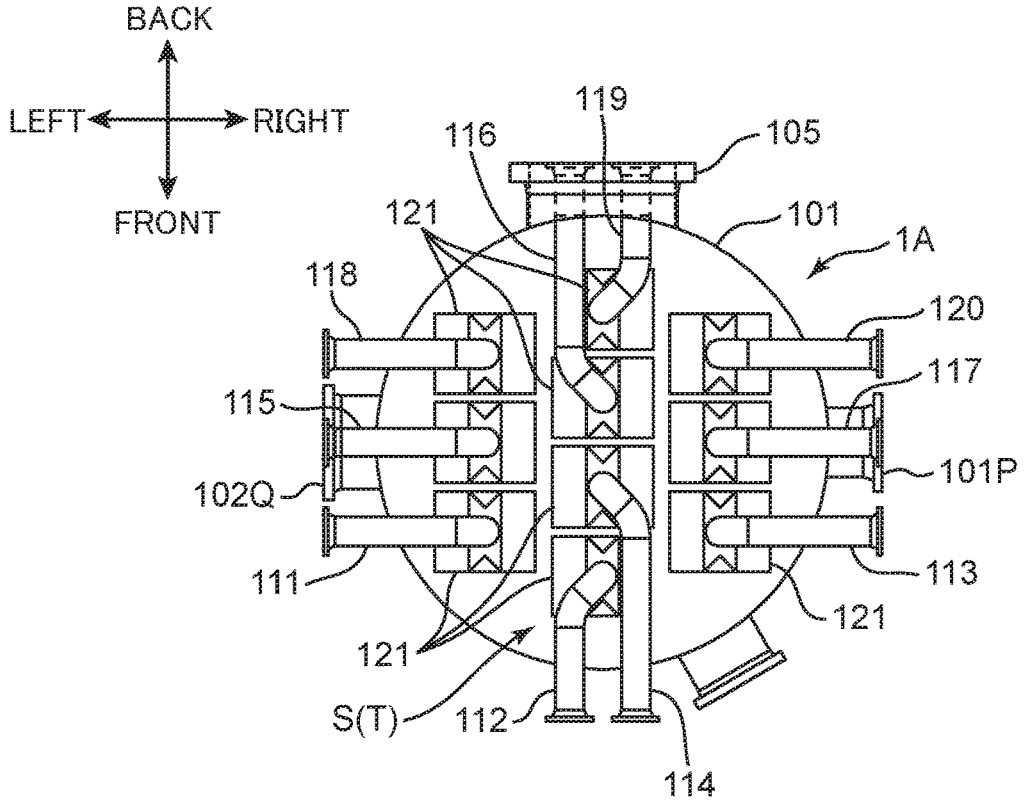
FIG. 8 is a horizontal sectional view of a first heat exchanger of the cooling device according to the second embodiment of the present invention.
Figure 9:
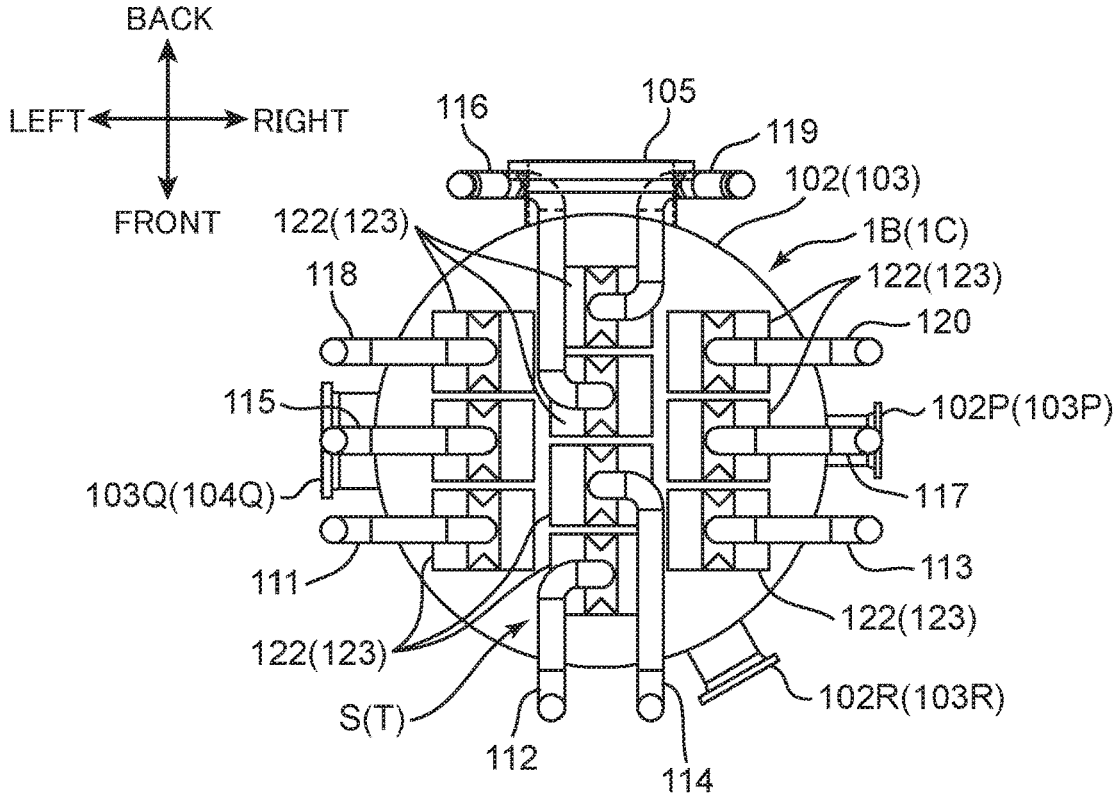
FIG. 9 is a horizontal sectional view of a second heat exchanger or a third heat exchanger of the cooling device according to the second embodiment of the present invention.
Figure 10:
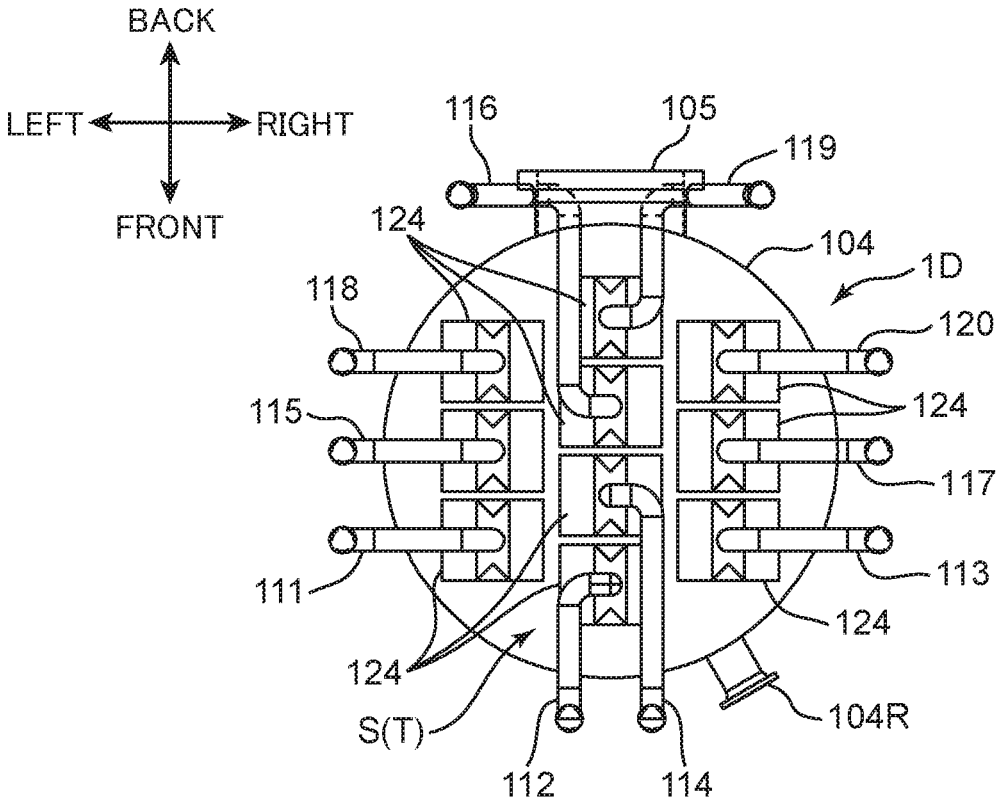
FIG. 10 is a horizontal sectional view of a fourth heat exchanger of the cooling device according to the second embodiment of the present invention.

Next, a second embodiment of the present invention will be described. In the present embodiment, different points from the first embodiment described above will be mainly described, and common points will not be described. The same applies to the following embodiments. FIG. 7 is a front sectional view of a gas cooling device 1M according to the present embodiment. FIG. 8 is a horizontal sectional view of a first heat exchanger 1A of the gas cooling device 1M according to the present embodiment. FIG. 9 is a horizontal sectional view of a second heat exchanger 1B or a third heat exchanger 1C of the gas cooling device 1M according to the present embodiment. FIG. 10 is a horizontal sectional view of a fourth heat exchanger 1D of the gas cooling device 1M according to the present embodiment. FIGS. 8, 9, and 10 respectively correspond to sectional views of positions VIII-VIII, IX-IX, and X-X of FIG. 7. In the figures, members having the same functions as the gas cooling device 1 of the first embodiment will be respectively given the same reference numerals as the first embodiment.

The present embodiment has a characteristic in a disposal structure of a first connection tube 111 to a tenth connection tube 120 in heat exchangers. That is, as shown in FIG. 7, the first connection tube 111 is disposed on the radially outside of a second drum 102 to bypass a demister 106 by passing through a second trunk portion 102A along the horizontal direction between a first bottom portion 101B and a second bottom portion 102B (bypass portion 111M) (see FIGS. 9 and 10). Similarly, the first connection tube 111 is disposed to bypass a demister 106 and pass through a third trunk portion 103A between the second bottom portion 102B and a third bottom portion 103B, and bypass a demister 106 and pass through a fourth trunk portion 104A between the third bottom portion 103B and a fourth bottom portion 104B. Similarly, in the third connection tube 113, bypass portions 113M are also disposed on the radially outside of the drum of each of the heat exchangers. As shown in FIGS. 9 and 10, the other flow passages are similarly partly disposed on the radially outside of the drums.

As a result, as in the first embodiment described above, the flow passages are not required to pass through the demister 106 or a demister support 107. Thus, there is no need for opening hole portions 107S in the demister support 107, and it is possible to simply set a structure around the demister 106. At this time, it is possible to expand the demister 106 in a disc shape up to the region of the demister support 107 in the embodiment described above. In the present embodiment, as described above, the flow passages pass through the trunk portions of the drums. Thus, a low-temperature-resistant material such as stainless steel is desirably used for the trunk portions or pass-through portions.

Third Embodiment

Figure 11:
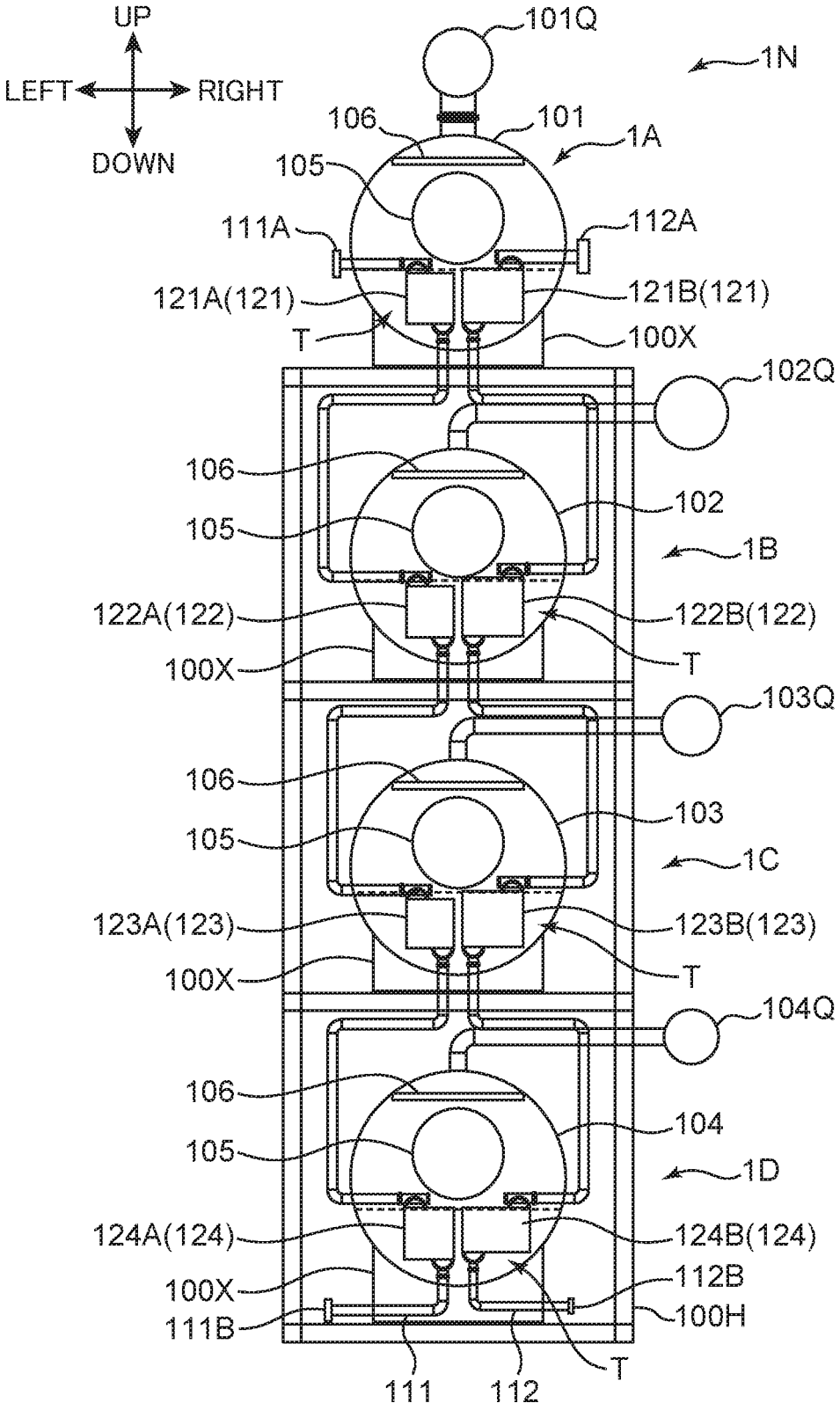
FIG. 11 is a front sectional view of a cooling device according to a third embodiment of the present invention.
Figure 12:
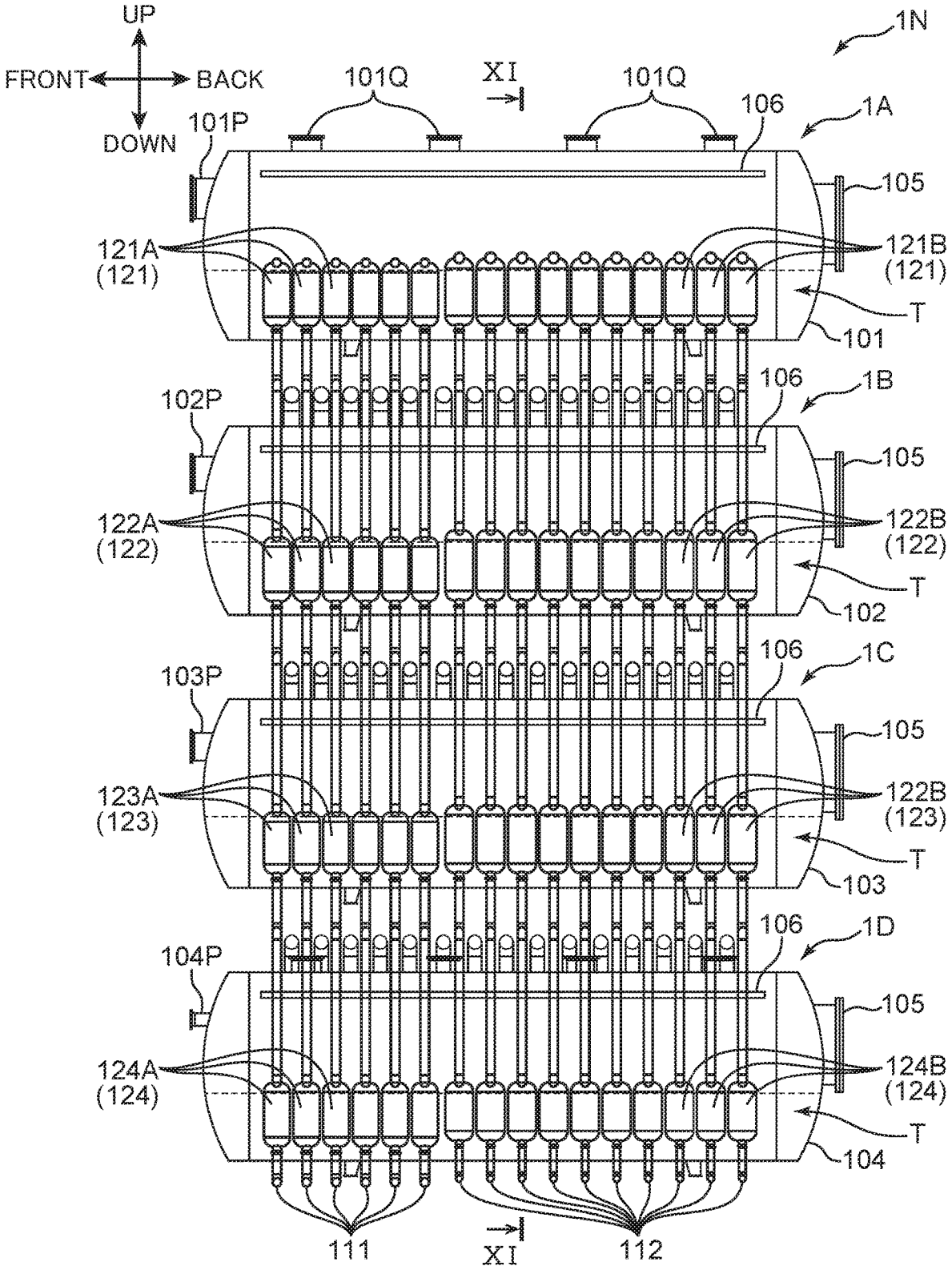
FIG. 12 is a side sectional view of the cooling device according to the third embodiment of the present invention.

Next, a third embodiment of the present invention will be described. FIG. 11 is a front sectional view of a gas cooling device 1N according to the present embodiment. FIG. 12 is a side sectional view of the gas cooling device 1N according to the present embodiment. FIG. 11 is a sectional view of a position XI-XI of FIG. 12. In the present embodiment, a first drum 101 of a first heat exchanger 1A, a second drum 102 of a second heat exchanger 1B, a third drum 103 of a third heat exchanger 1C, and a fourth drum 104 of a fourth heat exchanger 1D respectively have a cylindrical shape formed on a center axis which extends in the front to back direction (horizontal direction). In other words, in the third embodiment, the drums are placed sideways.

The gas cooling device 1N has a casing 100H, the heat exchangers are mounted hierarchically on the casing 100H, and the drums of the heat exchangers are respectively supported on bases 100X. As a result, even in the present embodiment, the first heat exchanger 1A to the fourth heat exchanger 1D are also arranged adjacently to each other along the up and down direction. As shown in FIG. 12, in the drum of each of the heat exchangers, a plurality of first heat exchanger core portions 121 (121A, 121B), second heat exchanger core portions 122 (122A, 122B), third heat exchanger core portions 123 (123A, 123B), or fourth heat exchanger core portions 124 (124A, 124B) are arranged adjacently in the front to back direction, and respectively cool and liquefy a natural gas flowing through a plurality of first connection tubes 111 and a plurality of second connection tubes 112. The reference numerals 121A, 122A, 123A, 124A of FIG. 12 denote the heat exchanger core portions for cooling the natural gas, and the reference numerals 121B, 122B, 123B, 124B denote the heat exchanger core portions for cooling the other mixture gas. That is, it is desirable to select proper heat exchanger core portions in accordance with a targeted fluid-to-be-cooled.

With the configuration described above, in comparison to the gas cooling device 1 according to the first embodiment, it is possible to reduce size of the gas cooling device 1N in the up and down direction. In a case where the number of the heat exchanger core portions in the drum of each of the heat exchangers is increased, it is possible to increase length of the drum and maintain a diameter. Thus, it is possible to handle without increasing thickness of the member.

Fourth Embodiment

Figure 13:
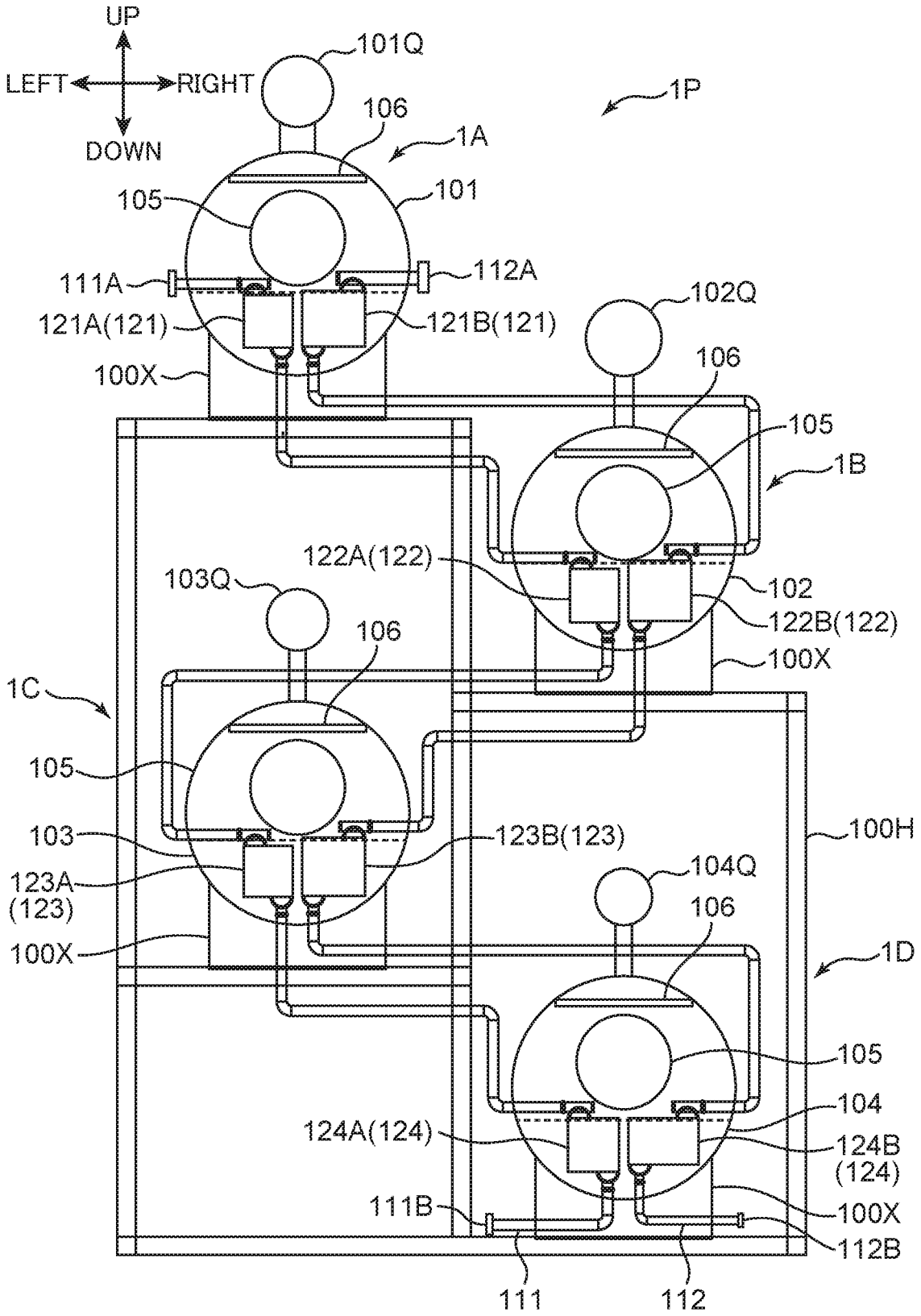
FIG. 13 is a front sectional view of a cooling device according to a fourth embodiment of the present invention.

Next, a fourth embodiment of the present invention will be described. FIG. 13 is a front sectional view of a gas cooling device 1P according to the present embodiment. In the third embodiment described above, the mode in which the drums of the heat exchangers which are placed sideways are arranged adjacently to each other in the up and down direction is described. However, as shown in FIG. 13, drums of heat exchangers may be arranged alternately on the left side and on the right side. In this case, it is possible to suppress height of the entire device.

The gas cooling devices 1, 1M, 1N, and 1P according to the embodiments of the present invention are described above. However, the present invention is not limited to these modes but the following modified embodiments are available.

(1) In the embodiments described above, the mode in which regarding the number of the heat exchanger core portions in each of the heat exchangers, the single heat exchanger core portion is arranged in each of the flow passages is described. However, the plurality of heat exchanger core portions may be arranged in each of the flow passages. In this case, the number of the heat exchanger core portions is desirably the same between the flow passages in each of the heat exchangers.

(2) In the embodiments described above, the mode in which the four heat exchangers are arranged up and down is described. However, two or more heat exchangers may be arranged up and down. The flow passages disposed to pass through the heat exchangers are not limited to ten but two or more (a specific number of) flow passages may be disposed.

(3) As in the first embodiment described above, the pipes of the flow passages may pass through the demister 106 itself instead of passing through the demister support 107. By letting the pipes pass through the demister support 107, the structure of the heat exchanger is simplified and cost reduction is realized. The demister 106 may be a demister which is attachable to and detachable from the drum and with which maintenance is easily performed. The mist separation portion according to the present invention is not limited to the demister 106 but may be made of other members capable of capturing the mist-shaped propane (refrigerant mist) associated with the propane gas (refrigerant gas).

The present invention provides a cooling device capable of receiving, cooling, and discharging a fluid-to-be-cooled. The cooling device includes a plurality of heat exchangers arranged at different positions from each other in the up and down direction, each of the heat exchangers having a refrigerant container that stores a liquid refrigerant for cooling the fluid-to-be-cooled, and a plurality of heat exchanger core portions immersed in the liquid refrigerant in the refrigerant container, the heat exchanger core portions that respectively permit the fluid-to-be-cooled to flow for performing heat exchange with the liquid refrigerant, and a plurality of heat exchanger connection portions respectively forming a plurality of cooling flow passages for the fluid-to-be-cooled to pass through the plurality of heat exchangers in order by connecting the heat exchanger core portions to each other between the heat exchangers adjacent to each other among the plurality of heat exchangers. Each of the plurality of heat exchanger connection portions includes a receiving port connected to the uppermost heat exchanger serving as the heat exchanger positioned on the uppermost among the plurality of heat exchangers, the receiving port that receives the fluid-to-be-cooled into the cooling flow passage, and a discharging port connected to the lowermost heat exchanger serving as the heat exchanger positioned on the lowermost among the plurality of heat exchangers, the discharging port that discharges the cooled fluid-to-be-cooled from the cooling flow passage. The plurality of cooling flow passages are disposed independently from each other at least from the uppermost heat exchanger to the lowermost heat exchanger.

According to the present configuration, the fluid-to-be-cooled flowing through the plurality of flow passages is deep-cooled by heat exchange with the liquid refrigerant in the plurality of heat exchanger core portions while passing through the plurality of heat exchangers. At least from the uppermost heat exchanger to the lowermost heat exchanger, the plurality of cooling flow passages are disposed independently from each other. Thus, even in a case where a damage such as leakage is generated in any one of the cooling flow passages, by closing the flow passage, it is possible to continuously cool the fluid-to-be-cooled in the other cooling flow passages having no leakage. Therefore, the cooling device capable of cooling the fluid-to-be-cooled without stopping the device before a planned maintenance time in a case where a failure such as leakage is generated in part of the cooling flow passages is provided.

In the configuration described above, desirably, each of the plurality of heat exchangers has a mist separation portion arranged in the refrigerant container, the mist separation portion being capable of separating a refrigerant mist and a refrigerant gas respectively generated from the liquid refrigerant by heat exchange with the fluid-to-be-cooled, the refrigerant container has a bottom wall defining a refrigerant storage portion that stores the liquid refrigerant, the mist separation portion is arranged on the vertically upper side of the plurality of heat exchanger core portions in the refrigerant container so that the refrigerant mist and the refrigerant gas generated from the liquid refrigerant are capable of reaching the mist separation portion when brought up from the plurality of heat exchanger core portions, and the bottom wall is arranged on the vertically lower side of the mist separation portion so that the mist-shaped liquid refrigerant captured by the mist separation portion is capable of dropping down to the liquid refrigerant stored in the refrigerant storage portion.

According to the present configuration, it is possible to effectively utilize a space in an upper portion of the heat exchanger required for maintenance of the heat exchanger as the mist separation portion. Thus, it is possible to minimize size of the entire device.

In the configuration described above, desirably, the plurality of heat exchanger core portions in the plurality of heat exchangers have a specific number of heat exchanger core portions, the plurality of heat exchanger connection portions have a specific number of heat exchanger connection portions which are as many as the heat exchanger core portions, and the specific number of heat exchanger connection portions connect a single heat exchanger core portion and a single heat exchanger core portion to each other between the heat exchangers adjacent to each other among the plurality of heat exchangers so that the single heat exchanger core portion is disposed in each of the plurality of cooling flow passages in the plurality of heat exchangers.

According to the present configuration, each one of the heat exchanger core portions is disposed in each of the specific number of cooling flow passages in each of the heat exchangers. Thus, even when the fluid-to-be-cooled becomes a two-phase flow containing a gas and a liquid in the cooling flow passage, there is no need for re-dispersing the two-phase flow between the plurality of cores unlike a case where a plurality of heat exchanger core portions are disposed in parallel in each of cooling flow passages. Thus, deviation of a flow rate of the fluid-to-be-cooled in the cooling flow passages is maintained to be minimum, and it is possible to prevent a decrease in a cooling processing capability.

In the configuration described above, desirably, the plurality of heat exchangers are connected to each other along the up and down direction, the refrigerant container further has a side wall arranged on the upper side of the bottom wall and connected to the bottom wall, and an upper wall portion connected to an upper end portion of the side wall, and each of the plurality of heat exchanger connection portions is disposed to respectively pass through the bottom wall of a single heat exchanger among the plurality of heat exchangers and the upper wall portion of another heat exchanger arranged on the lower side of the single heat exchanger.

According to the present configuration, connection between the heat exchangers by the heat exchanger connection portions is performed by passing through the bottom wall and the upper wall portion of the refrigerant container. Therefore, it is possible to reduce length of the heat exchanger connection portions (cooling flow passages) between the heat exchangers.

In the configuration described above, desirably, each of the plurality of heat exchangers has a separation support portion arranged to partition an interior of the refrigerant container into an upper portion and a lower portion, the separation support portion supporting the mist separation portion, the separation support portion that inhibits the refrigerant gas and the refrigerant mist from passing through the separation support portion while permitting the plurality of heat exchanger connection portions to respectively pass through the separation support portion along the up and down direction, and each of the plurality of heat exchanger connection portions is disposed to extend in the up and down direction in the refrigerant container along the side wall of the heat exchanger until reaching the bottom wall of the heat exchanger from the upper wall portion of the heat exchanger via the separation support portion.

According to the present configuration, the separation support portion can stably support the mist separation portion, and the plurality of cooling flow passages can be respectively disposed along the up and down direction over two regions in the refrigerant container divided by the mist separation portion. Therefore, the heat exchanger connection portions are not required to be disposed to pass through the side wall between the upper wall portion and the bottom wall. Thus, even in a case of considering that the fluid-to-be-cooled is brought into an excessively low temperature state by depressurization operation, there is no need for using a low-temperature-resistant material for the side wall.

In the configuration described above, desirably, the refrigerant container of each of the plurality of heat exchangers has a cylindrical shape including a center axis which extends in the up and down direction, and the upper wall portion of the refrigerant container has a downward-projected curved surface shape so that a center portion thereof is positioned on the lower side of the other portion.

According to the present configuration, by the refrigerant container of the heat exchanger having a cylindrical shape which extends in the up and down direction, it is possible to reduce size of the cooling device in the horizontal direction. It is also possible to ensure a space in which the liquid propane is stored and the heat exchanger core portion is immersed.

In the configuration described above, desirably, the refrigerant container further has a refrigerant gas discharging port disposed in the upper end portion of the side wall to oppose the projected portion of the upper wall portion of the heat exchanger in the horizontal direction, the refrigerant gas discharging port that permits the refrigerant gas separated by the mist separation portion to be discharged from the refrigerant container.

According to the present configuration, it is possible to stably discharge the refrigerant gas accumulated in a ring shape in a radially outside portion of the downward-projected upper wall portion from the refrigerant container through the refrigerant gas discharging port.

In the configuration described above, desirably, the plurality of heat exchangers are connected to each other along the up and down direction so that the bottom wall of the single heat exchanger also serves as the upper wall portion of the another heat exchanger.

According to the present configuration, it is possible to share the bottom wall and the upper wall portion between the heat exchangers adjacent to each other. Therefore, it is possible to reduce height size of the cooling device and also reduce cost of the cooling device.

In the configuration described above, desirably, each of the plurality of heat exchanger connection portions has both a mechanism of inhibiting the fluid-to-be-cooled from flowing into the cooling flow passage from the receiving port, and a mechanism of inhibiting the fluid-to-be-cooled from flowing back from the discharging port.

According to the present configuration, in a case where a damage such as leakage is generated in a predetermined cooling flow passage, it is possible to promptly inhibit a flow of the fluid-to-be-cooled in the flow passage. It is also possible to stably continue cooling processing of the fluid-to-be-cooled in the other flow passages.

In the configuration described above, desirably, the cooling device further includes a tubular casing extending along the up and down direction, and a plurality of partition portions that divide an interior of the casing into a plurality of refrigerant storage portions arranged adjacently to each other in the up and down direction, the refrigerant containers of the plurality of heat exchangers are respectively formed by the casing and the plurality of partition portions, the plurality of heat exchanger core portions of each of the plurality of heat exchangers are arranged to be immersed in the liquid refrigerant in the plurality of refrigerant storage portions of the casing, and the plurality of heat exchanger connection portions are respectively disposed to pass through the plurality of partition portions.

According to the present configuration, by partitioning the interior of the casing by the plurality of partition portions, it is possible to form the plurality of refrigerant storage portions. By respectively arranging the plurality of heat exchanger core portions in each of the refrigerant storage portions, it is possible to form a multiple-stage type cooling device.

In the configuration described above, desirably, the plurality of heat exchangers are respectively blazed aluminum plate-fin heat exchangers.

In the configuration described above, the plurality of heat exchangers may be respectively diffusion bonded heat exchangers.

The invention claimed is:

1. A cooling device capable of receiving, cooling, and discharging a fluid-to-be-cooled, comprising:

a plurality of heat exchangers arranged at different positions from each other in an up and down direction, each of the plurality of heat exchangers having a refrigerant container that stores a liquid refrigerant for cooling the fluid-to-be-cooled, and a plurality of heat exchanger core portions immersed in the liquid refrigerant in the refrigerant container, the plurality of heat exchanger core portions respectively permitting the fluid-to-be-cooled to flow for performing heat exchange with the liquid refrigerant; and a plurality of heat exchanger connection portions respectively forming a plurality of cooling flow passages for the fluid-to-be-cooled to pass through the plurality of heat exchangers in order by connecting the heat exchanger core portions to each other between the heat exchangers adjacent to each other among the plurality of heat exchangers, wherein each of the plurality of heat exchanger connection portions includes a receiving port connected to an uppermost heat exchanger serving as the heat exchanger positioned uppermost among the plurality of heat exchangers, the receiving port being for receiving the fluid-to-be-cooled into the cooling flow passage, and a discharging port connected to a lowermost heat exchanger serving as the heat exchanger positioned lowermost among the plurality of heat exchangers, the discharging port being for discharging the cooled fluid-to-be-cooled from the cooling flow passage, the plurality of cooling flow passages are disposed independently from each other at least from the uppermost heat exchanger to the lowermost heat exchanger, the plurality of heat exchangers are connected to each other along the up and down direction, the refrigerant container further has a side wall arranged on an upper side of a bottom wall and connected to the bottom wall, and an upper wall portion connected to an upper end portion of the side wall, the plurality of heat exchanger connection portions are respectively disposed to respectively pass through a bottom wall of a single heat exchanger among the plurality of heat exchangers and an upper wall portion of another heat exchanger arranged on a lower side of the single heat exchanger, each of the plurality of heat exchangers has a separation support portion arranged to partition an interior of the refrigerant container into an upper portion and a lower portion, the separation support portion supporting a mist separation portion, the separation support portion being for inhibiting a refrigerant gas and a refrigerant mist from passing through the separation support portion while permitting the plurality of heat exchanger connection portions to respectively pass through the separation support portion along the up and down direction, and each of the plurality of heat exchanger connection portions is disposed to extend in the up and down direction in the refrigerant container along the side wall of the heat exchanger until reaching the bottom wall of the heat exchanger from the upper wall portion of the heat exchanger via the separation support portion.

2. The cooling device according to claim 1, wherein the mist separation portion is for separating the refrigerant mist and the refrigerant gas respectively generated from the liquid refrigerant by heat exchange with the fluid-to-be-cooled, the refrigerant container bottom wall defines a refrigerant storage portion that stores the liquid refrigerant, the mist separation portion is arranged on a vertically upper side of the plurality of heat exchanger core portions in the refrigerant container so that the refrigerant mist and the refrigerant gas generated from the liquid refrigerant are capable of reaching the mist separation portion when brought up from the plurality of heat exchanger core portions, and the bottom wall is arranged on a vertically lower side of the mist separation portion so that a mist-shaped liquid refrigerant captured by the mist separation portion is capable of dropping down to the liquid refrigerant stored in the refrigerant storage portion.

3. The cooling device according to claim 1, wherein the plurality of heat exchanger core portions in the plurality of heat exchangers have a specific number of heat exchanger core portions, the plurality of heat exchanger connection portions have a specific number of heat exchanger connection portions which are as many as the heat exchanger core portions, and the specific number of heat exchanger connection portions connect a single heat exchanger core portion and a single heat exchanger core portion to each other between the heat exchangers adjacent to each other among the plurality of heat exchangers so that the single heat exchanger core portion is disposed in each of the plurality of cooling flow passages in the plurality of heat exchangers.

4. The cooling device according to claim 1, wherein the refrigerant container of each of the plurality of heat exchangers has a cylindrical shape including a center axis which extends in the up and down direction, and the upper wall portion of the refrigerant container has a downward-projected curved surface shape.

5. The cooling device according to claim 4, wherein the refrigerant container further has a refrigerant gas discharging port disposed in the upper end portion of the side wall to oppose a projected portion of the upper wall portion of the heat exchanger in a horizontal direction, the refrigerant gas discharging port permitting the refrigerant gas separated by the mist separation portion to be discharged from the refrigerant container.

6. The cooling device according to claim 1, wherein the plurality of heat exchangers are connected to each other along the up and down direction so that the bottom wall of the single heat exchanger also serves as the upper wall portion of the another heat exchanger.

7. The cooling device according to claim 1, wherein each of the plurality of heat exchanger connection portions has both an inlet side shutoff valve for inhibiting the fluid-to-be-cooled from flowing into the cooling flow passage from the receiving port, and an outlet side shutoff valve for inhibiting the fluid-to-be-cooled from flowing back to the cooling flow passage from the discharging port.

8. The cooling device according to claim 1, further comprising:

a tubular casing extending along the up and down direction; and a plurality of partition portions that divide an interior of the casing into a plurality of refrigerant storage portions arranged adjacently to each other in the up and down direction, wherein the refrigerant containers of the plurality of heat exchangers are respectively formed by the casing and the plurality of partition portions, the plurality of heat exchanger core portions of each of the plurality of heat exchangers are arranged to be immersed in the liquid refrigerant in the plurality of refrigerant storage portions of the casing, and the plurality of heat exchanger connection portions are respectively disposed to pass through the plurality of partition portions.

9. The cooling device according to claim 1, wherein the plurality of heat exchangers are respectively blazed aluminum plate-fin heat exchangers.

10. The cooling device according to claim 1, wherein the plurality of heat exchangers are respectively diffusion bonded heat exchangers.

* * * * *